US009629767B2

(12) United States Patent
Li

(10) Patent No.: US 9,629,767 B2
(45) Date of Patent: Apr. 25, 2017

(54) LIFTABLE HOSPITAL BED

(71) Applicant: Ningbo Kangmailong Medical Apparatus Co., Ltd., Cixi (CN)

(72) Inventor: Luping Li, Cixi (CN)

(73) Assignee: NINGBO KANGMAILONG MEDICAL APPARATUS CO., LTD., Cixi (CN)

( * ) Notice: Subject to any disclaimer, the term of this patent is extended or adjusted under 35 U.S.C. 154(b) by 0 days.

(21) Appl. No.: 14/378,899

(22) PCT Filed: Jan. 6, 2013

(86) PCT No.: PCT/CN2013/070093

§ 371 (c)(1),
(2) Date: Aug. 14, 2014

(87) PCT Pub. No.: WO2014/048075

PCT Pub. Date: Apr. 3, 2014

(65) Prior Publication Data

US 2015/0033472 A1 Feb. 5, 2015

(30) Foreign Application Priority Data

Sep. 27, 2012 (CN) ..... 2012 1 0369617

(51) Int. Cl.
*A61G 7/012* (2006.01)
*A61G 7/018* (2006.01)
(Continued)

(52) U.S. Cl.
CPC ..... *A61G 7/018* (2013.01); *A61G 1/0212* (2013.01); *A61G 1/0562* (2013.01); *A61G 7/005* (2013.01);
(Continued)

(58) Field of Classification Search
CPC ..... A61G 1/013; A61G 1/02; A61G 1/0212; A61G 1/0237; A61G 1/056; A61G 1/0562;
(Continued)

(56) References Cited

U.S. PATENT DOCUMENTS 114,034 A 4/1871 Pettit
5,084,922 A * 2/1992 Louit ..... A61G 1/0562 296/20
(Continued)

FOREIGN PATENT DOCUMENTS

CN 101199444 A 6/2008
CN 101632615 A 1/2010
(Continued)

OTHER PUBLICATIONS

International Search Report and Written Opinion dated May 3, 2012 for Application No. PCT/CN2012/070346.
(Continued)

*Primary Examiner* — David E Sosnowski
*Assistant Examiner* — David R Hare
(74) *Attorney, Agent, or Firm* — Wayne & King LLC

(57) ABSTRACT

Disclosed is a liftable hospital bed, comprising a bedplate base frame (1) symmetrical about a transverse central plane and a longitudinal central plane, wherein two ends of the bedplate base frame (1) are provided with bed leg rods (2), the lower end of the bed leg rods (2) being hinged to a first roller device (3) in contact with the ground and the upper end of the bed leg rods (2) being connected to a second roller device (4), the second roller device (4) being slidable in tracks (5) on the bedplate base frame (1) and the tracks (5) being parallel to a longitudinal axis of the bedplate base frame (1); connecting rods (6) are hinged to the bed leg rods (2); and a turnover mechanism is further provided for
(Continued)

changing included angles between the bed leg rods (2) and the bedplate base frame (1) to lift the bedplate base frame (1), the turnover mechanism comprises the connecting rods (6) and a thrust mechanism, end portions of the thrust mechanism drive the connecting rods (6) to rotate via a hinged four-rod mechanism (7), and the connecting rods (6) drive the bed leg rods (2) to turn over relative to the bedplate base frame (1), so that the lifting of the hospital bed is realized.

6 Claims, 8 Drawing Sheets

(51) Int. Cl.

| | |
|---|---|
| ***A61G 1/02*** | (2006.01) |
| ***A61G 1/056*** | (2006.01) |
| ***A61G 13/06*** | (2006.01) |
| ***A61G 13/04*** | (2006.01) |
| ***A61G 7/015*** | (2006.01) |
| ***A61G 7/005*** | (2006.01) |

(52) U.S. Cl.
CPC ..... *A61G 7/012* (2013.01); *A61G 7/015* (2013.01); *A61G 13/04* (2013.01); *A61G 13/06* (2013.01)

(58) Field of Classification Search
CPC ..... A61G 7/005; A61G 7/012; A61G 7/018; A61G 13/04; A61G 13/06; A61G 7/015; A47C 19/045
See application file for complete search history.

(56) References Cited

U.S. PATENT DOCUMENTS

| | | | | |
|---|---|---|---|---|
| 6,230,344 | B1 * | 5/2001 | Thompson | A47C 19/045 5/611 |
| 6,868,567 | B2 * | 3/2005 | Edgerton | A61G 7/015 5/600 |
| 7,003,828 | B2 * | 2/2006 | Roussy | A47C 19/045 5/600 |
| 7,334,277 | B2 * | 2/2008 | Johnson | A61G 1/0562 296/20 |
| 7,509,697 | B2 * | 3/2009 | Dorenbeck | A47C 19/045 5/611 |
| 2009/0094747 | A1 * | 4/2009 | Bly | A61G 7/012 5/611 |
| 2009/0100598 | A1 * | 4/2009 | Bly | A47C 20/043 5/510 |
| 2010/0064441 | A1 * | 3/2010 | Barthelt | A47C 19/045 5/616 |
| 2014/0041120 | A1 | 2/2014 | Li | |

FOREIGN PATENT DOCUMENTS

| | | | |
|---|---|---|---|
| CN | 201384633 | Y | 1/2010 |
| CN | 101658454 | A | 3/2010 |
| CN | 102038589 | A | 5/2011 |
| CN | 102389354 | | 3/2012 |
| CN | 102895081 | | 1/2013 |
| EP | 0496760 | B1 | 8/1992 |
| JP | 2558081 | B2 | 11/1996 |
| WO | WO 91/05532 | | 5/1991 |
| WO | WO 2012/139222 | | 10/2012 |
| WO | WO 2013/033980 | | 3/2013 |
| WO | WO 2014/048075 | | 4/2014 |

OTHER PUBLICATIONS

International Preliminary Report on Patentability dated Mar. 12, 2014 for Application No. PCT/CN2012/070346.
International Search Report dated Apr. 7, 2013 for Application No. PCT/CN2013/070093.
U.S. Appl. 13/980,799.
Linak, "The Electric Linear Actuator," accessed Sep. 18, 2015, http://www.linak-us.com/about?id3+4540, 1 pg.
Linak, "Product Data Sheet—Actuator LA27," Dec. 2012, accessed Sep. 18, 2015, http://www.linak-us.com/products/linear-actuators.aspx?product=LA27, 8 pgs.
International Written Opinion dated Apr. 7, 2013 for Application No. PCT/CN2013/070093.
US Office Action, Non-Final, dated Sep. 24, 2015 for U.S. Appl. No. 13/980,799.

* cited by examiner

LIFTABLE HOSPITAL BED

(I) FIELD OF THE INVENTION

The present invention relates to a liftable hospital bed.

(II) DESCRIPTION OF THE RELATED ART

Regular hinge structures are employed between connecting rods and bed leg rods of existing hospital beds, the longitudinal displacement during the release and retraction of the bed leg rods cannot be compensated, and the ends of bed leg rods that touch the ground will change their longitudinal positions relative to the hospital bed. As a result, the entire hospital bed moves. As one end of the hospital bed is against the wall, all of the bed legs that are away from the wall are forced to move back, which is accompanied with continuous vibration. Such a phenomenon typically results in discomfort to patients. For a patient in severe condition who is inserted with a variety of tubes, in particular, the dragging caused by the movement of the hospital bed will result in severe consequences and affect recovery. Due to various reasons, however, a hospital bed must be able to go up and down as required by medical treatment. How to reduce the displacement of bed legs during lifting and to keep the patient posture and position steady has consistently been a difficult problem in this technical field.

(III) SUMMARY OF THE INVENTION

In order to overcome the drawback that bed legs of the hospital bed according to the prior art move during lifting, the present invention is to provide a lifting hospital bed with the longitudinal positions of bed legs relative to the hospital bed remaining stationary during lifting.

The liftable hospital bed according to the present invention comprises a bedplate base frame that is symmetrical about a transverse central plane and a longitudinal central plane, two ends of the bedplate base frame being provided with bed leg rods and the lower end of the bed leg rods being hinged to a first roller device in contact with the ground, characterized in that:

The upper end of the bed leg rods are connected to a second roller device, the second roller device being slidable in tracks on the bedplate base frame and the tracks being parallel to a longitudinal axis of the bedplate base frame;

Connecting rods are hinged to the bed leg rods;

A turnover mechanism is further provided for changing the angles between the bed leg rods and the bedplate base frame to lift the bedplate base frame, the turnover mechanism comprising the connecting rods and a thrust mechanism, end portions of the thrust mechanism driving the connecting rods to rotate via a hinged four-rod mechanism, and the connecting rods driving the bed leg rods to turn over relative to the bedplate base frame, thereby realizing the lifting of the hospital bed.

Furthermore, the thrust mechanism is a first turbine worm mechanism driven by an electrical motor, and the thrust rod is the worm of the first turbine worm mechanism.

Furthermore, the hinged four-rod mechanism comprises a first circular tube and a second circular tube hinged to the bedplate base frame, the first circular tube is closer to the center of the bedplate base frame than the second circular tube is, a first connecting and support rod is fixedly connected to the first circular tube, a second connecting and support rod is fixedly connected to the second circular tube, a link rod is hinged between the first connecting and support rod and the second connecting and support rod, the upper end of the connecting rod is fixedly connected to the second circular tube, and the thrust rod is hinged to the first connecting and support rod.

Furthermore, the guide track appears to be of an inclined shape by being high on two ends of the bedplate base frame and low at the center thereof.

Yet furthermore, the bedplate placed on the bedplate base frame is connected to a second turnover mechanism, the driving device of the second turnover mechanism is a second turbine worm mechanism, control ends of the first turbine worm mechanism and the second turbine worm mechanism are both connected to a central controller, and the central controller is connected to a signal input device.

The present invention has a structure that is symmetrical laterally and longitudinally. There is a bed leg rod at each of the two sides of the front end and the back end of the hospital bed, and each bed leg rod has a connecting rod coordinating therewith; the connecting rods at two sides of the same end are connected via a cross rod therebetween, and the thrust mechanism is hinged with the cross rod.

When the electric motor rotates to drive the turbine, the turbine drives the worm to extend forward or retract backward. The front end of the worm drives the connecting rods to turn over relative to the bedplate base frame, and consequently the connecting rods pull the bed leg rods to turn over. Since the upper ends of the bed leg rods may move longitudinally in the bedplate base frame, the longitudinal displacement of the ground-touching ends of the bed leg rods in the process of lifting up and down is compensated such that the ground-touching ends of the bed leg rods remain stationary relative to the longitudinal position of the hospital bed.

In the process of lifting up and down according to the present invention, moreover, the arm of force that the thrust mechanism pushes the connecting rods to turn over is extended as the angle between the connecting rods and the bedplate base frame is increased. Consequently in the process of lifting up the hospital bed, the thrust from the thrust mechanism can be gradually decreased, and the power of the electric motor can be decreased. With the decreased power of electric motor, an electric motor with a smaller power can be installed, which at the same time can extend the life of the electric motor and reduce the production cost.

The inclined design of the guide track is favorable for bed leg rods to be closely attached to the bedplate base frame when the bed is at the lowest position, which reduces the overall thickness and decreased the use of storage space.

The present invention has the following advantages: the longitudinal position of ground-touching ends of the bed leg rods remain stationary relative to the hospital bed, which is favorable for keeping a patient steady during lifting up and down and favorable for treatment and recovery; secondly, the electric motor power can be reduced during the lifting up and down of a hospital bed, which is favorable for extending the life of the electric motor and reducing cost; finally, the thickness in the folded state is small, which saves storage space.

(IV) BRIEF DESCRIPTION OF THE DRAWINGS

(V) DETAILED DESCRIPTION OF THE PREFERRED EMBODIMENT

Figure 1:
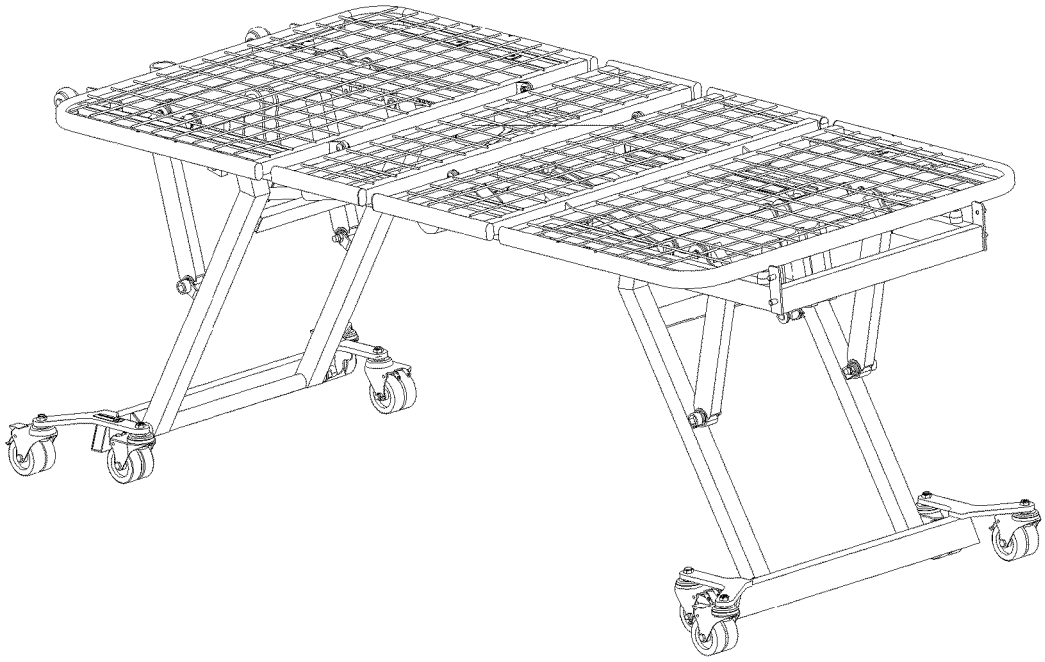
FIG. 1 illustrates the present invention in the lifted state
Figure 2:
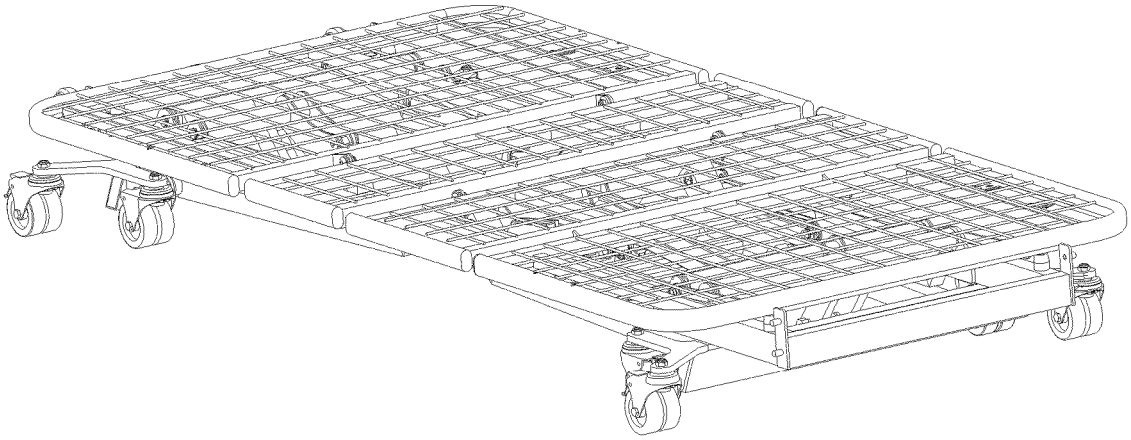
FIG. 2 illustrates the present invention in the lowered state
Figure 3:
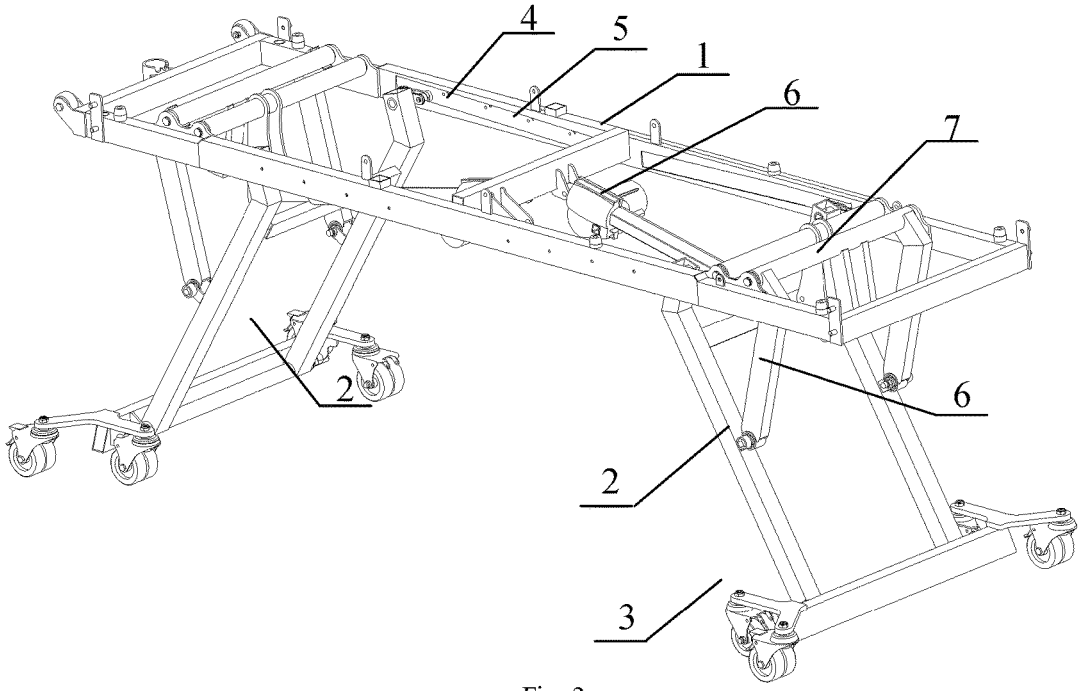
FIG. 3 illustrates the structure of the present invention in the lifted state
Figure 4:
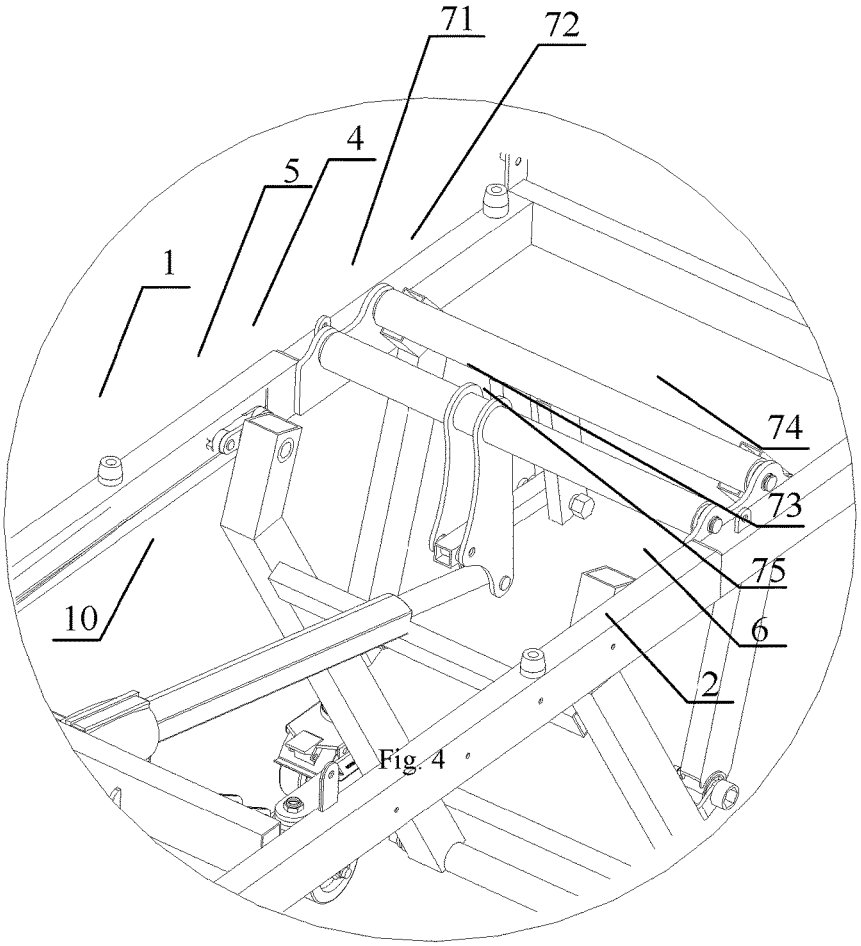
FIG. 4 is a partially enlarged view of FIG. 3
Figure 5:
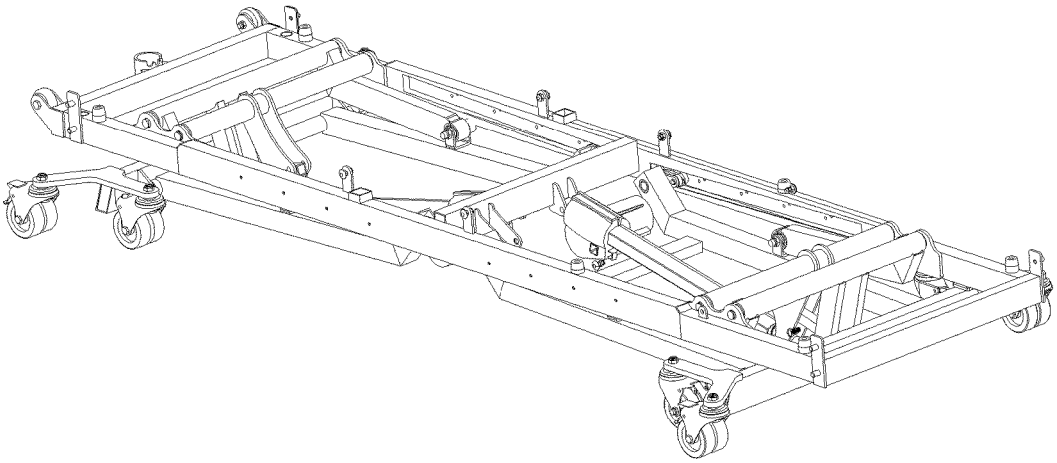
FIG. 5 is a 3D view of the present invention in the lowered state.
Figure 6:
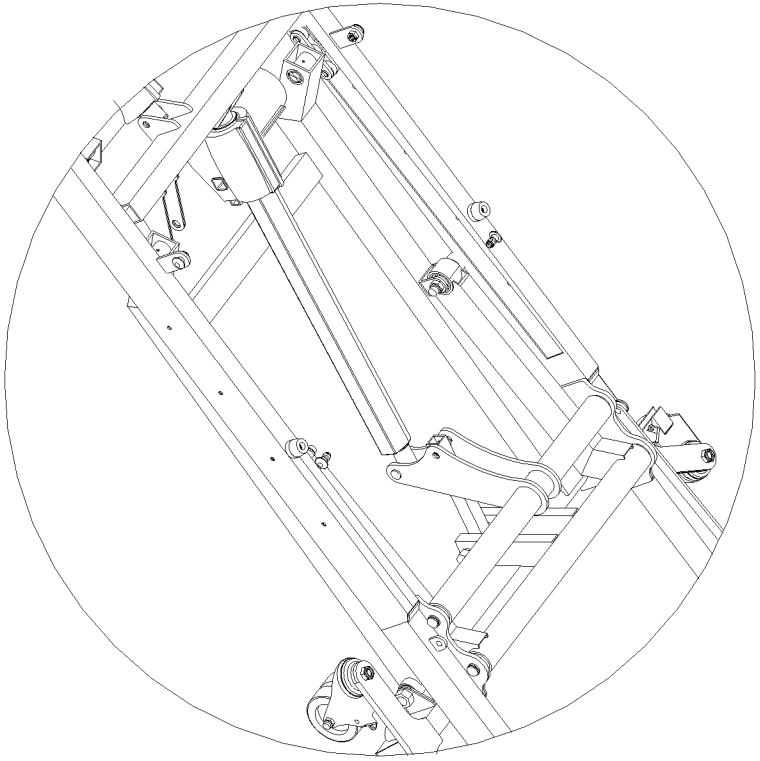
FIG. 6 is a partially enlarged view of FIG. 5
Figure 7:
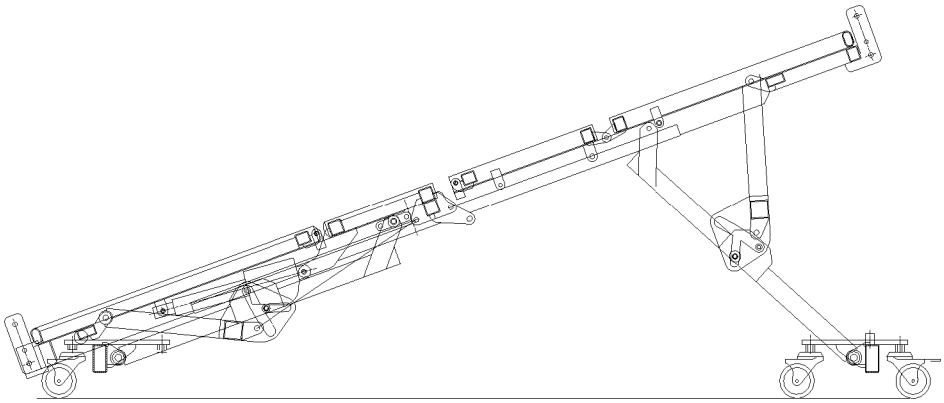
FIG. 7 illustrates the use of the present invention in the inclined state.
Figure 8:
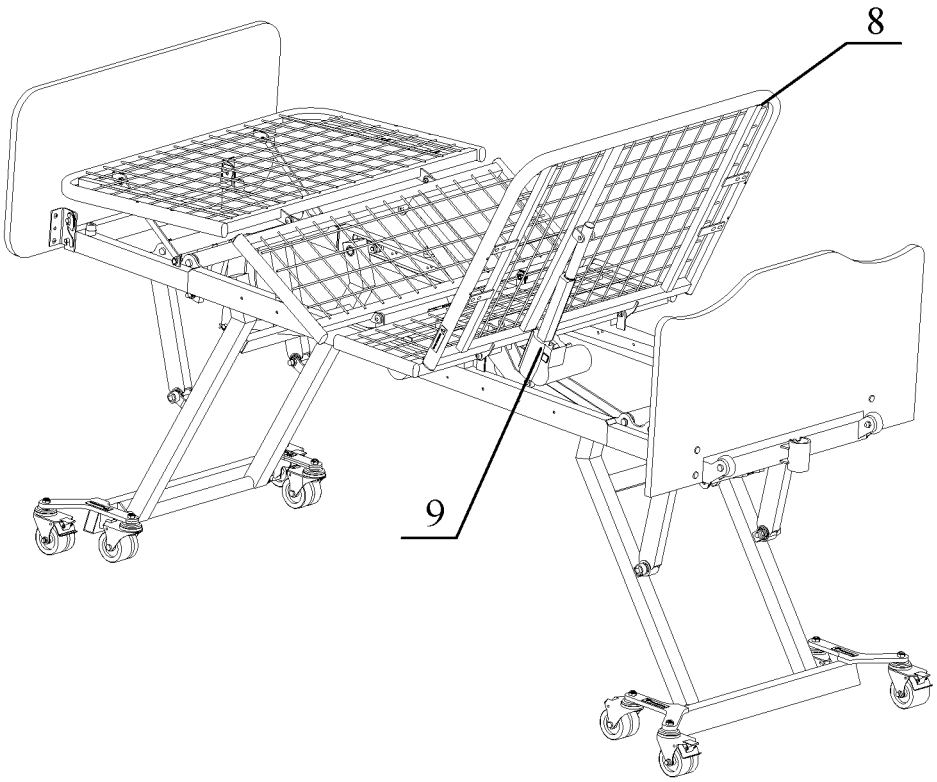
FIG. 8 is a 3D view of the structure of the present invention in the lowered state from another angle of view

The present invention will be further described below with reference to the accompanying drawings. Refer to the drawings:

The liftable hospital bed according to the present invention comprises a bedplate base frame 1, the bedplate base frame 1 is symmetrical about a transverse central plane and a longitudinal central plane, two ends of the bedplate base frame 1 is provided with bed leg rods 2 and the lower end of the bed leg rods 2 are hinged to a first roller device 3 in contact with the ground, characterized in that:

The upper end of the bed leg rods 2 are connected to a second roller device 4, the second roller device 4 being slidable in tracks 5 on the bedplate base frame 1 and the tracks 5 being parallel to a longitudinal axis of the bedplate base frame 1;

Connecting rods 6 are hinged to the bed leg rods 2;

A turnover mechanism is further provided for changing the angles between the bed leg rods 2 and the bedplate base frame 1 to lift the bedplate base frame 1, the turnover mechanism comprising the connecting rods 6 and a thrust mechanism, end portions of the thrust mechanism driving the connecting rods 6 to rotate via a hinged four-rod mechanism 7, and the connecting rods driving the bed leg rods 2 to turn over relative to the bedplate base frame 1, thereby realizing the lifting of the hospital bed.

The thrust mechanism is a first turbine worm mechanism 10 driven by an electrical motor, and the thrust rod is the worm of the first turbine worm mechanism 10.

The hinged four-rod mechanism comprises a first circular tube 71 and a second circular tube 72 hinged to the bedplate base frame 1, the first circular tube 71 is closer to the center of the bedplate base frame 1 than the second circular tube 72 is, a first connecting and support rod 73 is fixedly connected to the first circular tube 71, a second connecting and support rod 74 is fixedly connected to the second circular tube 72, a link rod 75 is hinged between the first connecting and support rod 73 and the second connecting and support rod 74, the upper end of the connecting rod 6 is fixedly connected to the second circular tube 72, and the thrust rod is hinged to the first connecting and support rod 73.

The guide track 5 appears to be of an inclined shape by being high on two ends of the bedplate base frame 1 and low at the center thereof.

The bedplate 8 placed on the bedplate base frame 1 is connected to a second turnover mechanism, the driving device of the second turnover mechanism is a second turbine worm mechanism 9, control ends of the first turbine worm mechanism 10 and the second turbine worm mechanism 9 are both connected to a central controller, and the central controller is connected to a signal input device.

The hospital bed may be lifted up or down through manual operations on the signal input device. The bed leg rods on both sides can be lifted up or down at the same time. Alternatively, bed leg rods on one side can be lifted up or down to adjust the degree of inclination of the hospital bed.

According to the present invention, bed legs remain substantially stationary during lifting up and down, which can ensure the steady posture of a patient. When the height is lowered, the overall thickness can be decreased for convenient storage and the use of storage space can be decreased.

The content of the embodiment in this Description is merely an example of ways to implement the invention concept. The scope of the present invention shall not be limited by the specific forms described in the embodiment. The scope of the present invention shall also encompass equivalent technical means that can be thought by those skilled in the art according to the concept of the present invention.

The invention claimed is:

1. A liftable hospital bed having a bedplate base frame that is symmetrical about a transverse central plane and a longitudinal central plane, with two ends of the bedplate base frame being provided with bed leg rods with a lower end of the bed leg rods being hinged to a first roller device in contact with the ground, the liftable hospital bed comprising:

an upper end of the bed leg rods connected to a second roller device, the second roller device being slidable in tracks on the bedplate base frame and the tracks being parallel to a longitudinal axis of the bedplate base frame; connecting rods hinged to the bed leg rods; and a turnover mechanism for changing the angles between the bed leg rods and the bedplate base frame to lift the bedplate base frame, the turnover mechanism comprising the connecting rods and a thrust mechanism, wherein end portions of the thrust mechanism are configured to drive the connecting rods to rotate via, a hinged four-rod mechanism, wherein the hinged four-rod mechanism comprises a first circular tube and a second circular tube, wherein each end of the first circular tube and the second circular tube are hinged directly to the bedplate base frame, and the connecting rods are configured to drive the upper end of the bed leg rods relative to the bedplate base frame, thereby realizing the filling of the hospital bed; wherein an upper end of the connecting rods is fixedly connected to the second circular tube;

wherein the thrust mechanism is a first turbine worm mechanism driven by an electrical motor, and a thrust rod is a worm of the first turbine worm mechanism, the first turbine worm mechanism is directly hinged to a lower end of a first connecting and support rod.

2. The liftable hospital bed as set forth in claim 1, characterized in that the first circular tube is closer to the center of the bedplate base frame than the second circular tube is, a first connecting and support rod is fixedly connected to the first circular tube, a second connecting and support rod is fixedly connected to the second circular tube, a link rod is hinged between the first connecting and support rod and the second connecting and support rod, an upper end of the connecting rods is fixedly connected to the second circular tube.

3. The liftable hospital bed as set forth in claim 2, characterized in that the liftable hospital bed is symmetrical laterally and longitudinally with one of the bed leg rods is positioned at each side of a front end and a back end of the hospital bed, and each one of the bed leg rods has one of the connecting rods coordinating therewith.

4. The liftable hospital bed as set forth in claim 3, characterized in that the tracks are inclined, being high on the front and back ends of the bedplate base frame and low at the center thereof.

5. The liftable hospital bed as set firth in claim 4, characterized in that a bedplate placed on the bedplate base frame is connected to a second turnover mechanism comprising a second turbine worm mechanism, wherein the first turbine worm mechanism and the second turbine worm mechanism are both connected to a central controller, and the central controller is connected to a signal input device.

6. A liftable hospital bed comprising:

a frame having, a track extending longitudinally along the frame;

a pair of bed leg rods adjustably connected to the frame;

a lower roller device connected to a lower end of the pair of bed leg rods, wherein the lower roller device is configured to contact a ground surface;

an upper roller device connected to an upper end of the pair of bed leg rods, wherein the upper roller device is movable along the track of the frame; at least one connecting rod hinged to the pair of bed leg rods; and an adjustment assembly configured to change the angle between the pair of bed leg rods and the frame to selectively raise and lower the frame by rotating the at least one connecting rod to translate the upper end of the pair of bed leg rods longitudinally relative to the frame via the upper roller device while the lower end of the pair of bed leg rods maintains longitudinal position relative to the frame, wherein the adjustment assembly comprises to hinged four-rod mechanism for rotating the at least one connecting rod, wherein the hinged four-rod mechanism comprises a first tube and a second tube each directly hinged to the frame, a first connecting and support rod fixedly connected to the first tube, a second connecting and support rod fixedly connected to the second tube, and a link rod hinged between the first connecting and support rod and the second connecting and support rod; wherein an upper end of the connecting rod is fixedly connected to the second tube; and wherein a first turbine worm mechanism is directly hinged to as lower end of the first connecting and support rod.

* * * * *